United States Patent [19]

Noji

[11] Patent Number: 4,686,417

[45] Date of Patent: Aug. 11, 1987

[54] X-RAY IMAGE INTENSIFIER

[75] Inventor: Takashi Noji, Odawara, Japan

[73] Assignee: Kabushiki Kaisha Toshiba, Kawasaki, Japan

[21] Appl. No.: 705,728

[22] Filed: Feb. 26, 1985

[30] Foreign Application Priority Data

Feb. 29, 1984 [JP] Japan ..... 59-36245

[51] Int. Cl.[4] ..... H01J 31/49; G21C 11/00

[52] U.S. Cl. ..... 313/479; 315/85; 250/515.1

[58] Field of Search ..... 313/388, 390, 239, 240, 313/242, 313, 479; 250/213 VT, 505.1, 515.1; 315/85; 252/478

[56] References Cited

U.S. PATENT DOCUMENTS 3,858,050 12/1974 Carlson ..... 250/515.1

*Primary Examiner*—Palmer C. DeMeo
*Assistant Examiner*—Sandra L. O'Shea
*Attorney, Agent, or Firm*—Cushman, Darby & Cushman

[57] ABSTRACT

An X-ray image intensifier apparatus consists of an X-ray image intensifier having an input window and an input screen opposing the input window, and a container for storing the X-ray image intensifier, and has a good contrast property. An X-ray shielding member comprising a resin in which a particulate material having X-ray shielding and absorbing effects is dispersed is provided on a peripheral portion of an input side of the X-ray image intensifier apparatus.

15 Claims, 20 Drawing Figures

X-RAY IMAGE INTENSIFIER

BACKGROUND OF THE INVENTION

The present invention relates to a radioactive ray image intensifier and, more particularly, to an improvement in contrast property in an X-ray image intensifier.

X-ray image intensifiers are widely utilized as an aid in the diagnosis of diseases in the medical field and for non-destructive testing in the industrial field.

An X-ray image intensifier has a configuration shown in FIG. 1. An evacuated envelope 1 is maintained at a high vacuum pressure and consists of an X-ray input window 2 of a thin metal plate, a body 5 mainly of a glass material, and a glass output window 4. An input screen 6, a focusing electrode 7, an anode 8 and an output screen 9 are disposed in the evacuated envelope 1. The input screen 6 comprises an aluminum substrate 10, a phosphor layer 11 formed thereon, and a photoemissive layer 12 formed on the layer 11. The output screen 9 comprises a glass substrate 13, a phosphor layer 14 formed thereon, and a metal back layer 15 formed on the layer 14.

X-rays emitted from an X-ray source 20 and transmitted through an object (not shown) pass through the X-ray input window 2 and are converted into visible light by the phosphor layer 11 formed on the input screen 6. Furthermore, the visible light is converted into photo electrons by the photoemissive layer 12 formed on the layer 11. The photo electrons are accelerated and focused by the focusing electrode 7 and the anode 8 constituting an electron lens, and are converted into visible light again in the output screen 9, thus forming a visible image.

The visible image is observed through the output window 4 or a television set, or is observed as a photograph, thus aiding in the diagnosis of disease. Therefore, in order to facilitate an accurate diagnosis, the image appearing on the output screen 9 must be of high quality.

When an X-ray image intensifier is used, it is arranged in an X-ray diagnosis apparatus. In this case, the image intensifier itself is fixed in a container (housing) 16 by a supporting mechanism 17. A magnetic shield 18 for reducing the effect of an external magnetic field and lead plates **19*a* and 19*b* for preventing X-ray leakage are attached to an inner surface of the container 16. The amount of X-ray leakage allowed in an image intensifier is regulated by the Welfare Ministry. For this reason, a lead plate which is thick enough to satisfy this regulation (e.g., 1.5 mm or more) must be attached. The shape and arrangement of electrodes in an electron lens system in the image intensifier are determined by computer calculations. The input screen 6 has a curved shape. An effective area of the screen 6 for receiving X-rays corresponds to a region indicated by A in FIG. 1. Note that a diverging angle of X-rays corresponding to the region A is indicated by a in FIG. 1**. In this case, light emitted by the phosphor layer outside the effective irradiation area A is not received by the electron lens system.

X-rays emitted from an X-ray tube 20 at a constant diverging angle c toward the image intensifier are incident on an input portion region of the container 16 defined by the lead plate **19*b* attached to an inner wall of an input portion thereof. A diverging angle corresponding to this region is b. These angles a, b and c satisfy a relation $a < b < c$. When the X-rays are irradiated on an object, X-ray scattering or diffraction (reflection) occurs. In other words, an X-ray component of a diverging angle between the angles a and b is irradiated on the input portion, thereby generating a scattered X-ray, and an X-ray component of a diverging angle larger than the angle b is irradiated on the lead plate 19*b*, thereby also generating a scattered X-ray. These X-ray components are transmitted through the input window of the thin metal plate having a good X-ray transmission property, thus exciting the phosphor layer 11** of the effective irradiation region A. This results in degradation of contrast property in the X-ray image intensifier.

The effective irradiation region A of the input screen and the diverging angles a, b and c vary in accordance with a geometrical arrangement of the X-ray source, e.g., the X-ray tube 20 and a structure of the X-ray image intensifier. For this reason, an area of the region which generates the scattered or reflected X-ray by irradiation of an X-ray component of a diverging angle larger than the angle a is slightly varied. In this case, the scattered or reflected X-ray amount is determined by a material of a peripheral member in the region on which such an X-ray component is irradiated, e.g., the peripheral member of the input portion of the container 16 or the input window. Note that the container 16 is generally formed of an aluminum alloy and the input window is formed of aluminum, aluminum alloy, stainless steel, glass or the like.

In an image pickup tube utilizing light, an optical system such as a lens is utilized for converging light. For this reason, an incident angle of light is large. On the other hand, an X-ray incident upon the X-ray image intensifier is an X-ray cone having a directivity emitted from a point X-ray source. Therefore, since the X-ray has a high energy and is irradiated at a small incident angle, it is easily subject to scattering or reflection described above on a plane of incidence.

In recent X-ray image intensifiers, in order to further aid diagnosis of minute portions of an object, demand has arisen for an improvement in image quality by improving contrast property. Also, in order to use a diagnostic apparatus using digital image processing, a good contrast property is required.

Therefore, inconveniences in an X-ray image intensifier apparatus caused by scattering or reflection of an incident X-ray must be reduced in addition to an improvement in characteristics of the image intensifier itself.

SUMMARY OF THE INVENTION

It is an object of the present invention to provide an X-ray image intensifier apparatus with good contrast property.

An X-ray image intensifier apparatus according to the present invention comprises an X-ray image intensifier having an input window and an input screen opposing the input window, and a container for storing the X-ray image intensifier. An X-ray shielding member formed of a resin film in which a particulate material having X-ray shielding and absorbing properties dispersed is provided on a peripheral portion of an input side of the X-ray image intensifier apparatus.

The peripheral portion of the apparatus on which the X-ray shielding member is to be provided is a peripheral portion of the input window and/or a front peripheral portion of the container.

The particulate material having the X-ray shielding and absorbing properties comprises a powder of a metal having a high atomic number or a compound thereof, e.g., lead powder, tungsten powder, and the like. A particle size of the particulate material preferably falls within the range between several micrometers and 100 micrometers. A dispersion amount of the particulate material is preferably 30 to 90% by volume. When the amount of the particulate material is less than 30% by volume, the X-ray shielding effect of the X-ray shielding member is degraded. On the other hand, when the amount of the material exceeds 90% by volume, the X-ray absorbing effect is degraded. Both of the above result in degradation in contrast.

A resin film in which a particulate material is dispersed can be any material which is not degraded by irradiation of X-rays. For example, a polyvinyl chloride film can be used. The resin is used as a material of the X-ray shielding member because it can be easily deformed and cut into a desired shape, and is relatively safe since harmful lead cannot be exposed in a surface when lead powder is used as the particulate material. In addition, the resin film cannot be discolored by corrosion and therefore high quality is maintained. The resin film is easily mass-produced, and easily detached.

A surface of the X-ray shielding member can be colored, and another resin film can be formed thereon.

A thickness of the X-ray shielding member is preferably 0.5 mm or more.

DETAILED DESCRIPTION OF THE PREFERRED EMBODIMENTS

Figure 1:
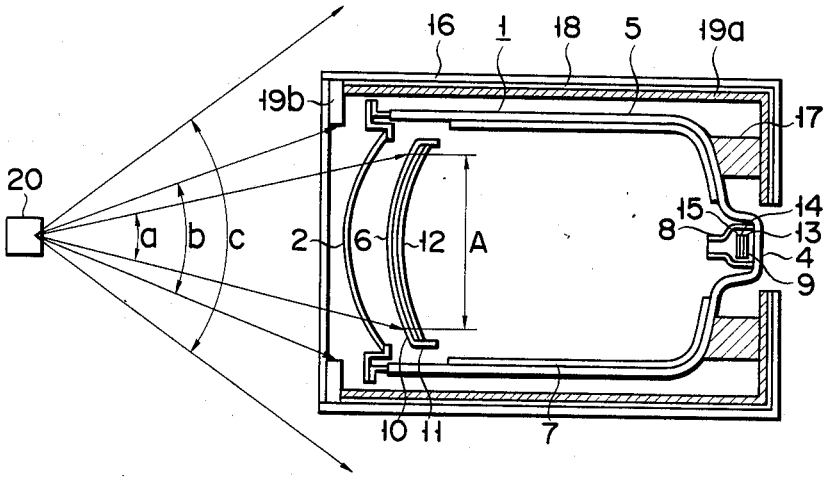
FIG. 1 (PRIOR ART)
FIG. 1 is a sectional view of a conventional X-ray image intensifier apparatus.

Various embodiments of the present invention will be described hereinafter with reference to the accompanying drawings. Note that the same reference numerals as in FIG. 1 showing the conventional apparatus denote the same parts in FIG. 2, and a detailed description thereof will be omitted.

Figure 2:
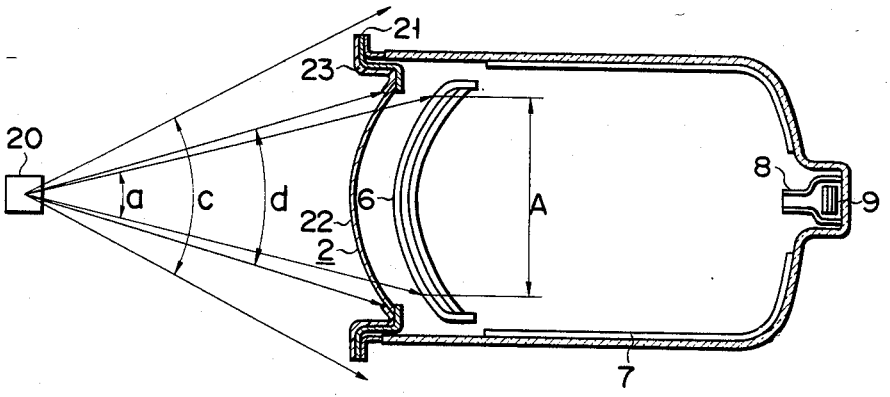
FIG. 2 is a sectional view of an X-ray image intensifier according to an embodiment of the present invention.

FIG. 2 is a sectional view showing an X-ray image intensifier apparatus according to one embodiment of the present invention. In FIG. 2, an input window 2 is a curved plate 22 made of aluminum which is fixed in an airtight manner to a support ring 21 of stainless steel. An X-ray shielding member 23 with good X-ray shielding and absorbing effects is provided on an outer surface of a peripheral portion of the input window 2. The X-ray shielding member 23 is positioned so as not to diminish an effective irradiation region A of an input screen 6 and so as to shield an X-ray of a diverging angle d or more in accordance with a practical distance between an X-ray tube 20 and the X-ray image intensifier. The X-ray shielding member 23 is not limited to a one-piece molded body shown in FIG. 2, but can be divided into several parts.

Figure 3A:
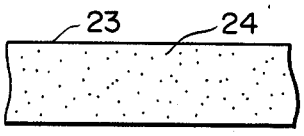
FIGS. 3A to 3D are respectively representations showing various dispersion states of a particulate material in a resin film.

The X-ray shielding member 23 is formed of a resin sheet, e.g., a polyvinyl chloride sheet in which a fine particulate material having good X-ray shielding and absorbing effects, e.g., lead powder 24 is dispersed, as shown in FIG. 3A. The resin sheet can be an easily bent and cut to shape the X-ray shielding member to fit a mounting portion of the input screen. The fine particulate material can have any size and does not have to be uniform. A thickness of the X-ray shielding member 23 is 1 mm, and corresponds to a lead sheet of 0.22 mm thickness. The X-ray shielding and absorbing effects can be increased in accordance with an increase in the thickness of the member 23.

Figure 3B:
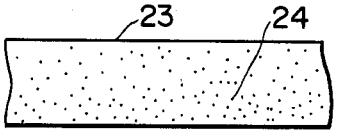
Figure 3C:
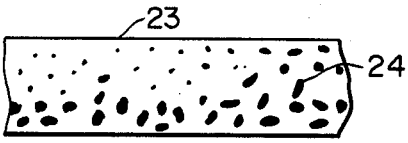
Figure 3D:
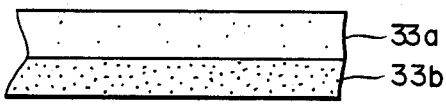

FIGS. 3B to 3D show modifications of the X-ray shielding member. In FIG. 3B, the lead powder 24 is provided at a high density on one side of the surface of the resin sheet 23. In FIG. 3C, the lead powder 24 having different particle sizes is dispersed in the resin sheet 23. In FIG. 3D, a first X-ray shielding member 33*a* having the lead powder 24 at a low density is adhered to a second X-ray shielding member 33*b* having the lead powder 24 at a high density. When the density of the fine particulate material is increased, the X-ray shielding effect of the X-ray shielding member can be increased.

Figure 4A:
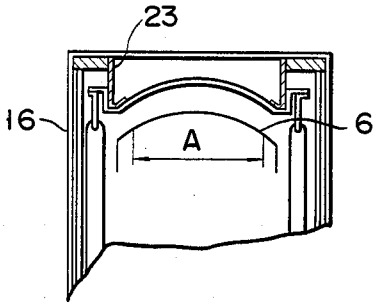
FIGS. 4A to 4D are views showing various mounting methods of an X-ray shielding member.
Figure 4B:
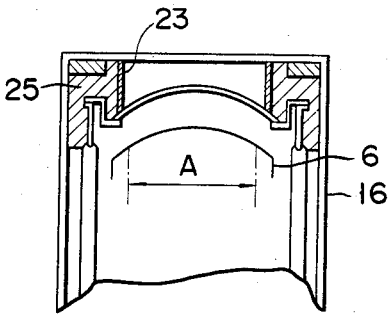
Figure 4C:
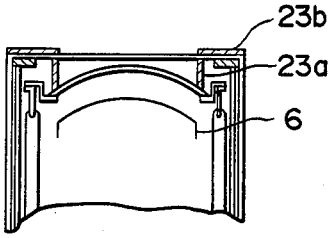
Figure 4D:
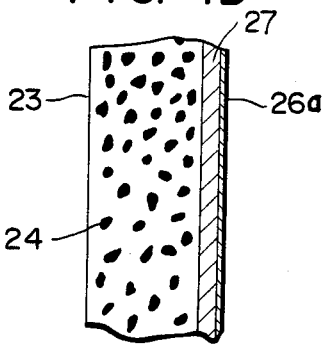

As shown in FIG. 2, the X-ray shielding member 23 can be fixed to the input window 2 using an adhesive agent. However, the member 23 can be arranged on an outer surface of the input window 2 by being mechanically fixed to the container 16. FIG. 4A shows the X-ray shielding member 23 which is formed into a cylindrical shape so as to correspond to the shapes of the container 16 and the X-ray image intensifier. FIG. 4B shows the X-ray shielding member 23 which is attached to a surface of a silicone resin 25 used for preventing corrosion of the input window 2 and for fixing an evacuated envelope 1. Furthermore, as shown in FIG. 4C, a ring-shaped X-ray shielding member 23*b* can be provided at a front peripheral portion of the container 16 in addition to a cylindrical X-ray shielding member 23*a*. When the X-ray shielding member is mounted by an adhesive agent, an adhesive agent layer 26*a* is formed on one surface of the member and a protective layer 27 is formed thereon, as shown in FIG. 4D. Thus, when the member is mounted, the protective layer 27 is removed therefrom and the resultant structure can be simply mounted.

An input part of the evacuated envelope of the X-ray image intensifier apparatus of the present invention can comprise various materials and shapes. For example, a material of the input window is not limited to aluminum, but can be glass, titanium, steel or the like. Mounting of the X-ray shielding member according to the present invention can be performed so as to suit the materials and shapes of the input window or the support member.

Figure 5A:
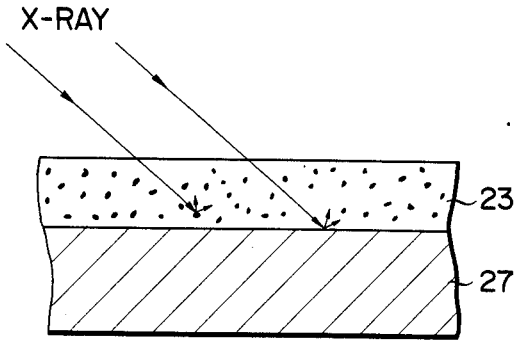
FIGS. 5A to 5C are views for explaining an X-ray absorption mechanism using the X-ray shielding member.
Figure 5B:
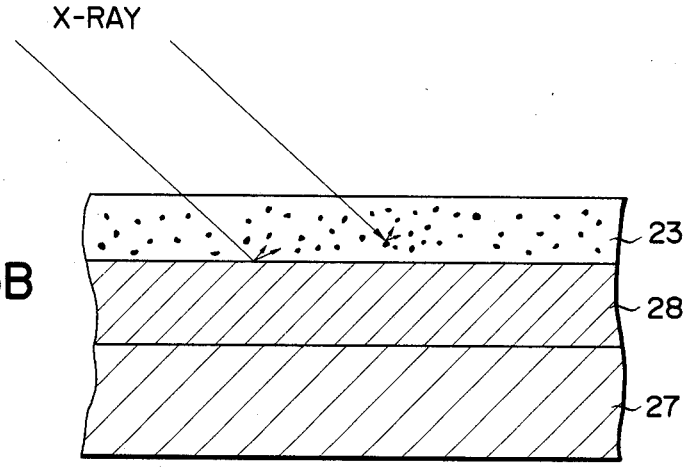
Figure 5C:
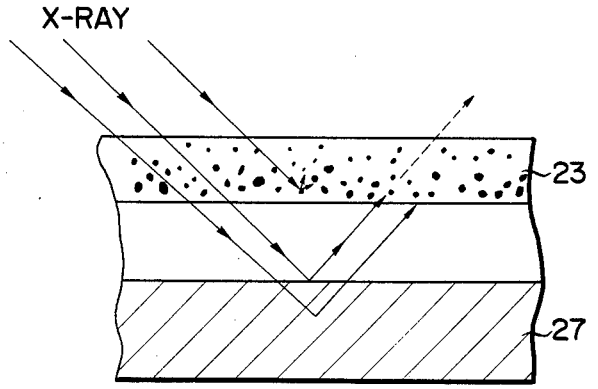

A mechanism wherein the X-ray shielding member can absorb X-rays without causing scattering and reflection in the X-ray image intensifier apparatus of the present invention will be described with reference to FIGS. 5A to 5C. In FIG. 5A, X-rays incident upon the X-ray shielding member 23 enter therein without being reflected by a surface of the member 23, and are scattered and attenuated by the lead powder particles dispersed. When an amount of the lead powder dispersed in the layer 23 is small, some X-rays reach the member 27 on which the member 23 is fixed and are reflected by a surface thereof so as to be absorbed in the member 23. However, the remaining X-rays may be transmitted through the member 27. In this case, a lead plate 28 is provided between the X-ray shielding member 23 and the member 27 so as to prevent the X-rays from being transmitted through the member 27, as shown in FIG. 5B. Instead of the lead plate 28, an organic material such as a silicone resin can be provided, or as shown in FIG. 5C, a hollow portion can be formed between the members 23 and 27.

In the X-ray image intensifier apparatus according to the present invention, the X-ray shielding member is provided at a front peripheral portion of the input window and/or the container for storing the image intensifier. For this reason, when X-rays are incident upon these portions, they can be absorbed therein. Thus, a scattered or reflected X-ray is not be generated and is not undesirably incident upon an effective irradiation region of the input screen.

Figure 6:
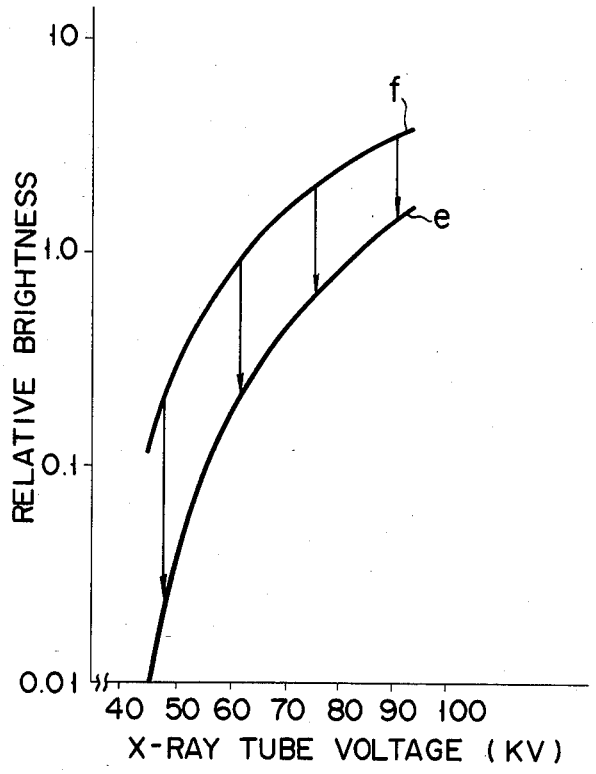
FIG. 6 is a graph showing an X-ray shielding effect of the X-ray shielding member.

An X-ray shielding effect of the X-ray shielding member 23 is shown in FIG. 6. FIG. 6 is a graph showing the relationship between a voltage of the X-ray tube and a brightness of the output screen both in the case wherein the overall front surface of the X-ray image intensifier is covered with the X-ray shielding member which corresponds to a 0.22-mm thickness lead film (indicated by curve e) and in the case wherein the X-ray shielding member is removed (indicated by curve f). As is apparent from this graph, the X-ray shielding effect of the X-ray shielding member of the present invention is satisfactory regardless of the X-ray tube voltage. When a thickness of the X-ray shielding member or a dispersion amount of the particulate material is increased, the X-ray shielding effect can be improved.

Figure 7:
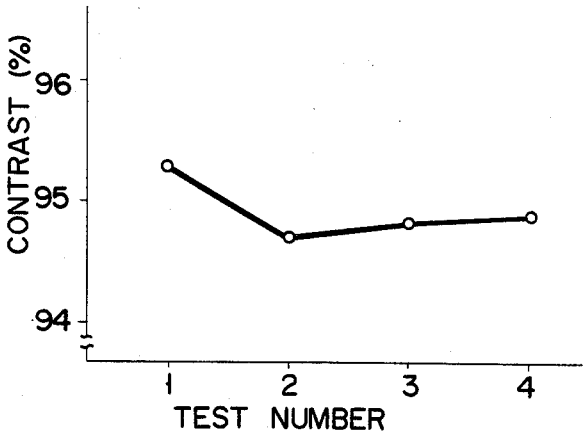
FIGS. 7 and 9 are graphs showing good contrast property in the X-ray image intensifier apparatus according to the present invention.

Furthermore, the X-ray shielding member of the present invention has not only a good X-ray shielding effect but also a satisfactory X-ray absorbing effect. The scattering or reflecting of X-ray can be effectively prevented, thus improving contrast property in the X-ray image intensifier. FIG. 7 is a graph showing an improvement in contrast of the X-ray image intensifier apparatus according to the present invention. In FIG. 7, Test 1 shows a contrast in the apparatus of the present invention in which the X-ray shielding member is arranged as shown in FIG. 4A, and Tests 2 to 4 show contrast in the conventional apparatus. Test 2 shows a contrast in the case wherein a diaphragm (not shown) of the X-ray tube 20 is fully open, Test 3 shows a contrast in the case wherein the diaphragm is closed to a position at which X-rays emitted therefrom circumscribe the effective irradiation region A, and Test 4 shows a contrast in the case wherein a 2-mm thickness lead ring is provided on a front surface of the container. Measurement of the contrast is performed as follows. Brightnesses at a central portion of the output screen 9 are obtained in the cases wherein a lead disk (2 mm thickness) having an area corresponding to 10% that of the effective irradiation region A is attached onto the tube axis at the front surface of the input window 2, and wherein the lead disk is not provided. Then, a ratio of these brightnesses is used as a contrast.

As is apparent from the graph. in FIG. 7, the X-ray image intensifier apparatus of the present invention which can effectively prevent generation of scattered and reflected X-rays has a satisfactory contrast. Particularly, the contrast of the apparatus of the present invention in Test 1 is greatly improved to 95.3% with respect to the apparatus in Test 2 with the contrast of 94.8%. According to another expression of the contrast property, the contrast property 19.2 : 1 of Test 2 is improved to the contrast property 21.3 : 1 of Test 1.

Figure 8A:
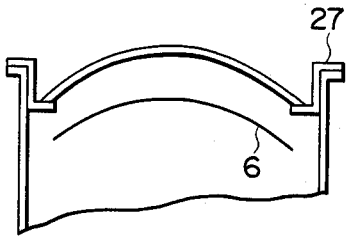
FIG. 8A (PRIOR ART)
FIGS. 8A to 8C are sectional views showing various arrangements of the X-ray image intensifier apparatuses which are used for obtaining data shown in FIG. 9.
Figure 8B:
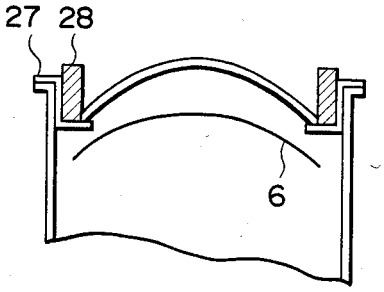
Figure 8C:
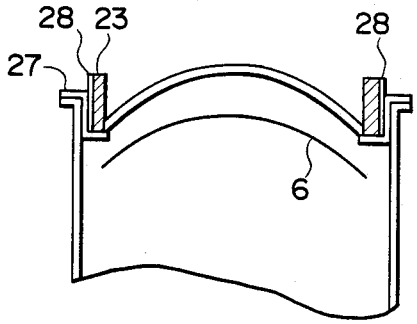
Figure 9:
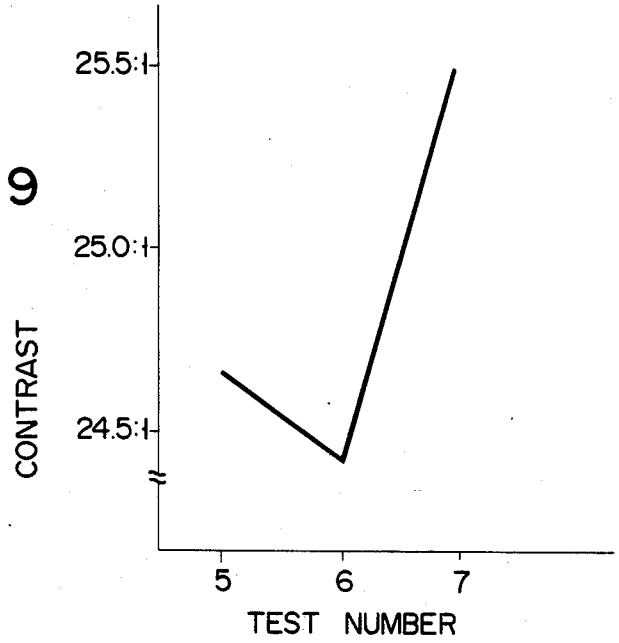

In other tests, it was found that the X-ray image intensifier apparatus according to the present invention had a satisfactory contrast property. FIG. 9 shows the contrast properties of three arrangements of the apparatus shown in FIGS. 8A to 8C. FIG. 8A shows the prior art wherein no X-ray shielding member is provided (Test 5). FIG. 8B shows an example wherein a lead cylindrical member 28 having a thickness of 1 mm is provided on the peripheral portion of the input window 2 (Test 6). FIG. 8C shows another example wherein the lead cylindrical member 28 having a thickness of 0.5 mm is provided at the same position as that in FIG. 8B and the lead sheet X-ray shielding member 23 of the present invention having the X-ray shielding effect corresponding to that of a 0.2-mm thickness lead sheet is provided on an inner surface of the member 28 (Test 7). When the contrasts of these apparatuses are measured under the same conditions, the graph shown in FIG. 9 is obtained. In FIG. 9, the apparatus according to the present invention has the best contrast property. Note that the apparatus shown in FIG. 8B has the worst contrast because the scattered and reflected X-rays caused by the cylindrical member 28 are incident upon the effective irradiation region of the input screen.

Figure 10:
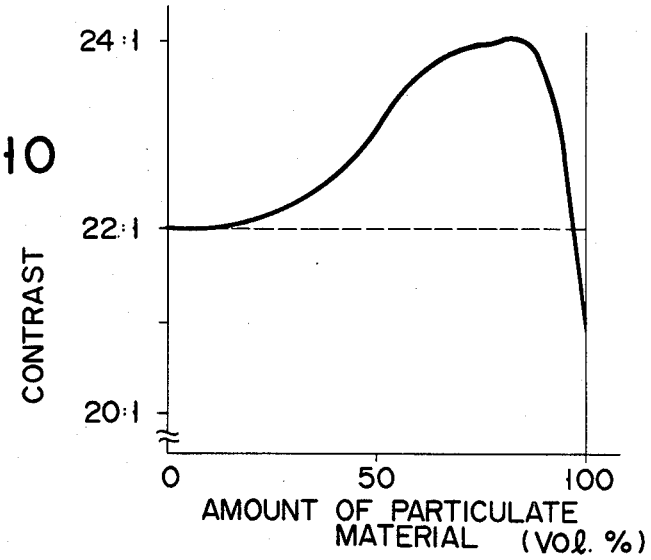
FIG. 10 is a graph showing the relationship between an amount of a particulate material in the X-ray shielding member and contrast property.

The relationship between a dispersion amount of the particulate material in the X-ray shielding member of the present invention and the contrast property will be described hereinafter. FIG. 10 is a graph showing a change in contrast when an amount of the lead powder (particle size: about 100 $\mu$m) dispersed in the polyvinyl chloride sheet is changed. As is apparent from the graph in FIG. 10, although the contrast in the case wherein no lead powder is dispersed is 22 : 1, the contrast is increased in accordance with an increase in the amount of the dispersed lead powder. Conversely, when the lead powder amount approaches 100%, the contrast is degraded to a degree lower than that of the case wherein the lead powder amount is 0%.

The particulate material 24 in the X-ray shielding member 23 can be shaped and arranged as desired. However, a shape and an arrangement which allows a transmission of primary X-rays and prevents the transmission of scattered X-rays is preferably adopted. For example, when the particulate material 24 is shaped into a columnar or plate-like shape and is aligned along an incident direction of X-rays, the X-ray absorbing effect of the X-ray shielding member 23 can be greatly improved.

Recently, an improvement in the performance of the X-ray image intensifier has been gained as repesented by a metal II (image intensifier). However, an improvement in contrast by the shielding of scattered X-rays cannot be obtained with the above, and represents an important drawback. According to an X-ray image intensifier apparatus of the present invention, instead of or in addition to a conventional X-ray shielding effect obtained with a lead sheet, the X-ray shielding member of a resin in which a particulate material having good X-ray shielding and absorbing effects is dispersed is used. Therefore, X-rays can be effectively shielded and absorbed without generating scattered and reflected X-rays on a surface of the member, thereby improving a contrast property. The X-ray image intensifier apparatus of the present invention can provide a high quality image further aiding diagnosis.

What is claimed is:

1. An X-ray image intensifier apparatus, comprising:

an input window on an input side of said apparatus, said input window adapted to have x-rays incident thereupon;

an input screen opposing the input window; and means for X-ray shielding, comprising a resin in which a particulate material having X-ray shielding and absorbing effects is dispersed, provided on a peripheral portion of said input side of said X-ray image intensifier apparatus and having an incident surface, adjacent to an area of X-ray incidence, and a peripheral surface, facing away from said incident surface, an area of said incident surface having a lower density of said particulate material than an area of said peripheral surface.

2. An apparatus according to claim 1, wherein said X-ray shielding means is mounted by using an adhesive agent.

3. An apparatus as in claim 1 further comprising means for containing the X-ray image intensifier apparatus.

4. An apparatus according to claim 3, wherein said X-ray shielding means is mounted on a peripheral portion of said input window.

5. An apparatus according to claim 4, wherein said X-ray shielding means is further mounted on a front surface peripheral portion of said containing means.

6. An apparatus according to claim 1, wherein the particulate material is a powder of a metal selected from the group consisting of lead and tungsten.

7. An apparatus according to claim 6, wherein a particle size of the particulate material falls within a range between several micrometers to 100 micrometers.

8. An apparatus according to claim 1, wherein a dispersion amount of the particulate material falls within a range between 30 and 90% by volume.

9. An apparatus according to claim 1, wherein the resin is not degraded due to irradiation of X-rays.

10. An apparatus according to claim 9, wherein the resin is polyvinyl chloride.

11. An apparatus according to claim 1, wherein said X-ray shielding means has a thickness of not less than 0.5 mm.

12. An X-ray image intensifier apparatus, comprising:

an input window, disposed to receive X-rays incident thereupon, and having a peripheral portion extending around an outer peripheral area thereof;

an input screen, opposing said input window in a direction that X-rays passing through said input window will be incident upon said input screen, said input screen having an effective irradiation region within which said input screen is operational, and outside of which said input screen is not effective, said effective irradiation region being a region smaller than an entire region defining said input screen; and blocking means, opposisng said input window and on an opposite side of said window than is said input screen, for preventing X-rays which would fall outside of said effective irradiation region from passing to said effective irradiation region.

13. An apparatus as in claim 12 wherein said blocking means is formed of a resin in which a particulate material having X-ray shielding and absorbing effects is dispersed.

14. An apparatus as in claim 13 further comprising means for containing said apparatus.

15. An apparatus as in claim 14 wherein said blocking means has a first surface adapted to oppose incident X-rays and a second surface facing away from said first surface, and wherein said first surface has a lower density of said particulate material than said second surface.

* * * * *